US006971557B2

(12) United States Patent
Mather et al.

(10) Patent No.: US 6,971,557 B2
(45) Date of Patent: Dec. 6, 2005

(54) ACTUATOR FOR A PRESSURIZED MATERIAL DISPENSER

(75) Inventors: David P. Mather, Milwaukee, WI (US); Edward J. Kunesh, Franksville, WI (US); Allen D. Miller, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 224 days.

(21) Appl. No.: 10/465,099

(22) Filed: Jun. 19, 2003

(65) Prior Publication Data

US 2004/0256417 A1 Dec. 23, 2004

(51) Int. Cl.[7] ..... B65D 83/00

(52) U.S. Cl. ..... 222/402.13; 222/182; 222/330; 239/337

(58) Field of Search ..... 222/402.13, 402.22, 222/182, 190, 402.1, 547, 575, 565, 330; 239/589, 595, 601, 318, 337

(56) References Cited

U.S. PATENT DOCUMENTS

| | | | | | |
|---|---|---|---|---|---|
| 2,913,749 | A | | 11/1959 | Ayres | |
| 3,128,922 | A | * | 4/1964 | Kuster | 222/389 |
| 3,166,250 | A | | 1/1965 | Kappel | |
| 3,365,138 | A | | 1/1968 | Green | |
| 3,437,270 | A | | 4/1969 | Venus Jr. | |
| 3,504,862 | A | | 4/1970 | Lowry | |
| 3,541,581 | A | | 11/1970 | Monson | |
| 3,545,682 | A | | 12/1970 | Beard | |
| 3,572,591 | A | * | 3/1971 | Brown | 239/337 |
| 3,583,642 | A | | 6/1971 | Crowell et al. | |
| 3,709,437 | A | | 1/1973 | Wright | |
| 3,711,031 | A | * | 1/1973 | Ewald | 239/601 |
| 3,744,678 | A | | 7/1973 | Beres et al. | |
| 3,767,125 | A | * | 10/1973 | Gehres et al. | 239/552 |
| 3,779,464 | A | * | 12/1973 | Malone | 239/350 |
| 3,785,571 | A | * | 1/1974 | Hoening | 239/492 |
| 3,838,822 | A | * | 10/1974 | Ewald | 239/596 |
| 3,970,219 | A | * | 7/1976 | Spitzer et al. | 222/1 |
| 4,027,789 | A | | 6/1977 | Dickey | |
| 4,046,289 | A | | 9/1977 | Teranishi | |
| 4,184,615 | A | | 1/1980 | Wright | |
| 4,274,594 | A | | 6/1981 | Ito | |
| 4,322,037 | A | | 3/1982 | Heeb et al. | |
| 4,420,099 | A | | 12/1983 | Pizzurro et al. | |
| 4,429,814 | A | | 2/1984 | Scotti et al. | |
| 4,515,315 | A | | 5/1985 | Corsette | |
| 4,636,102 | A | | 1/1987 | Drake | |
| 4,860,933 | A | | 8/1989 | Morane et al. | |

(Continued)

FOREIGN PATENT DOCUMENTS

| | | | | |
|---|---|---|---|---|
| DE | 19937554 A1 | 3/2001 | ..... | B65D 83/28 |
| GB | 2340891 A | 3/2000 | ..... | B65D 83/16 |

*Primary Examiner*—Frederick Nicolas

(57) ABSTRACT

An actuator orifice and an actuator for enhancing or creating a foam from a pressurized material dispenser. The actuator includes a skirt attached to the dispenser and a trigger movably mounted to the skirt. The trigger includes a flow conduit with a socket for receiving a valve stem. The socket exerts pressure on the stem to release contents of the dispenser. The trigger includes a hollow flow diverter located within the chamber. The flow diverter has a side wall and an end wall extending inwardly from the flow diverter side wall. The flow diverter side wall in turn has slots that provide fluid paths between the flow conduit and a surrounding chamber. The chamber side wall has recesses. Each slot laterally directs contents of the dispenser into at least one of the recesses in the chamber side wall when the valve is activated by the trigger.

19 Claims, 5 Drawing Sheets

U.S. PATENT DOCUMENTS 4,884,750 A 12/1989 Werding
4,901,891 A 2/1990 Goncalves
4,967,964 A 11/1990 Pamper
4,978,035 A 12/1990 Morane et al.
5,110,052 A 5/1992 Graf et al.
5,147,087 A 9/1992 Fuchs
5,232,127 A 8/1993 Trotta et al.
5,255,851 A 10/1993 Tobler
5,340,031 A 8/1994 Neuhaus et al. ..... 239/343
5,344,079 A 9/1994 Tasaki et al.
5,516,045 A 5/1996 Baudin
5,540,389 A 7/1996 Knickerbocker
5,617,978 A 4/1997 Geier
5,676,311 A 10/1997 Hartman
5,702,036 A 12/1997 Ferrara, Jr.
5,730,332 A 3/1998 Zimmerhackel
5,769,325 A 6/1998 Jouillat et al.
5,791,524 A 8/1998 Demarest
5,858,343 A 1/1999 Szymczak
5,951,882 A 9/1999 Simmons et al.
5,992,765 A 11/1999 Smith
6,000,633 A * 12/1999 Lund et al. ..... 239/211
6,161,735 A * 12/2000 Uchiyama et al. ..... 222/402.13
6,264,964 B1 7/2001 Mohammadi
6,283,337 B1 9/2001 Nakamura et al.
6,367,711 B1 4/2002 Benoist
6,371,389 B1 4/2002 Bickart et al.
6,402,054 B1 6/2002 Prueter et al.
6,405,898 B1 6/2002 O'Connor et al.
6,443,370 B1 9/2002 Brulle et al.
6,491,187 B2 12/2002 Walters
2002/0130198 A1 9/2002 Bennett

* cited by examiner

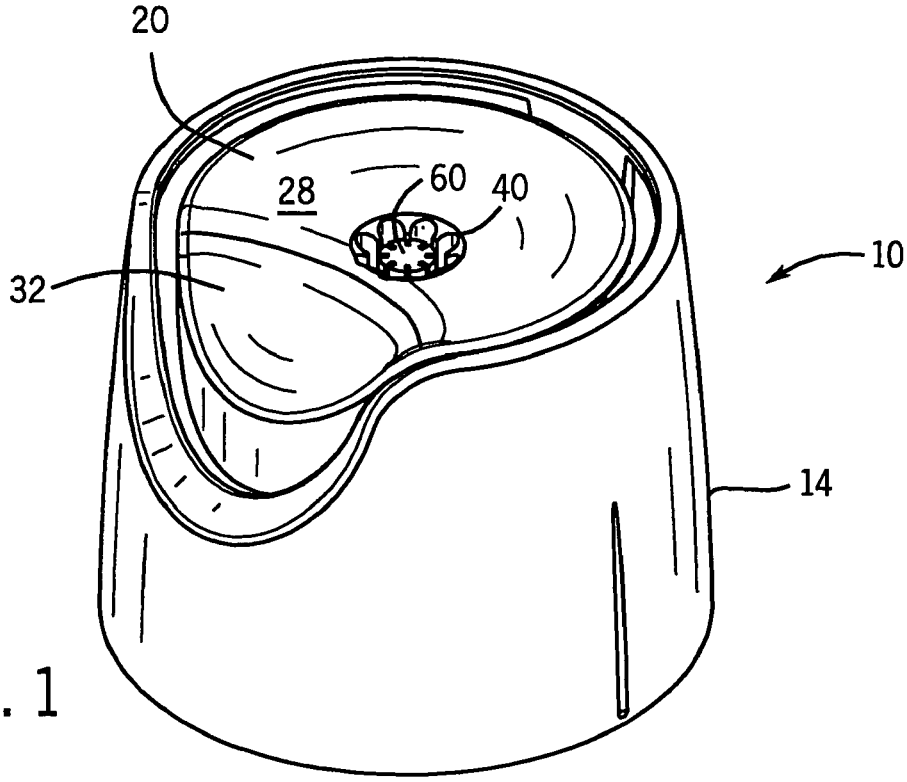
FIG. 1
FIG. 2
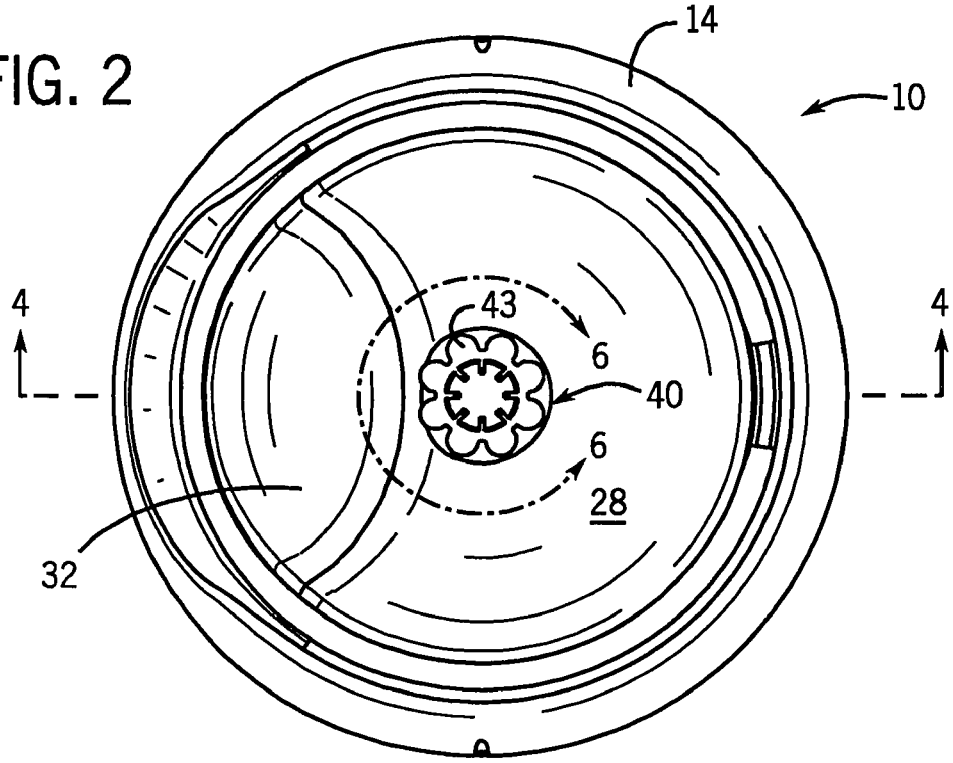

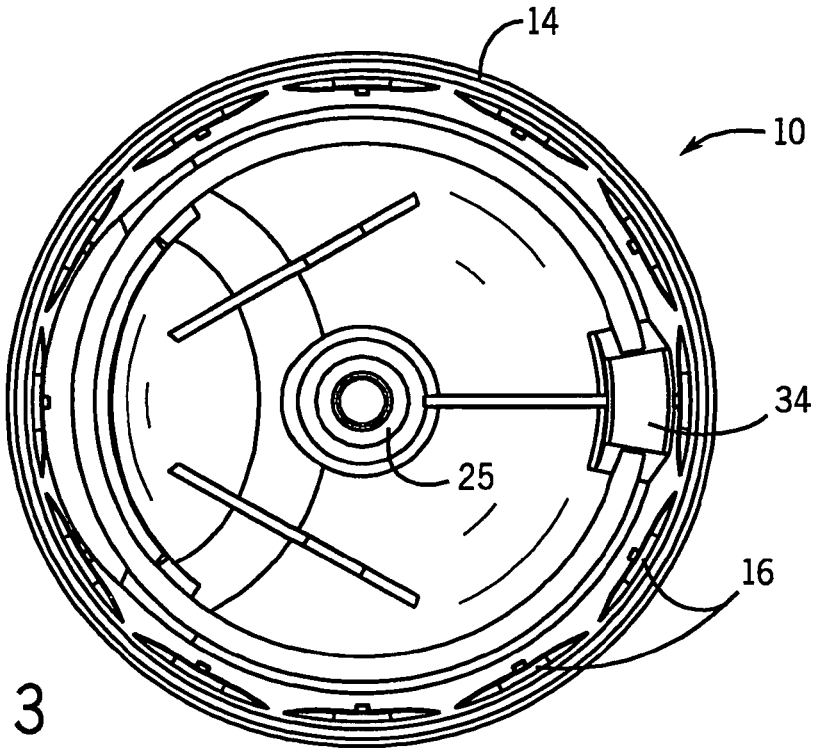
FIG. 3
FIG. 4
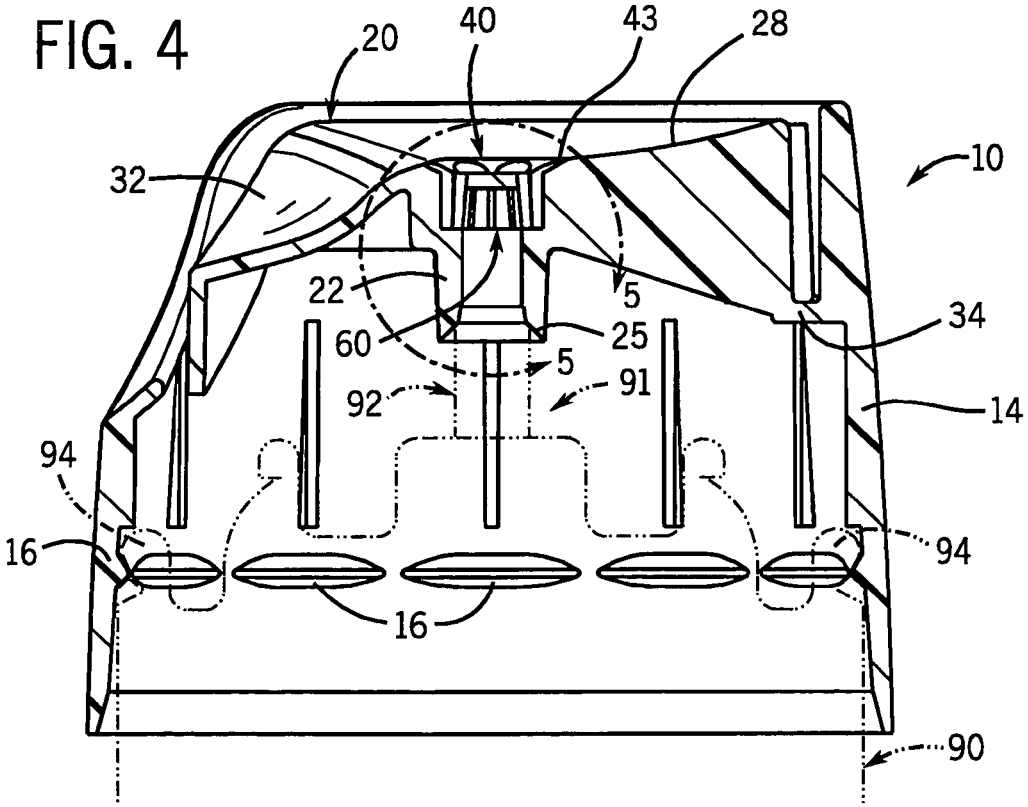

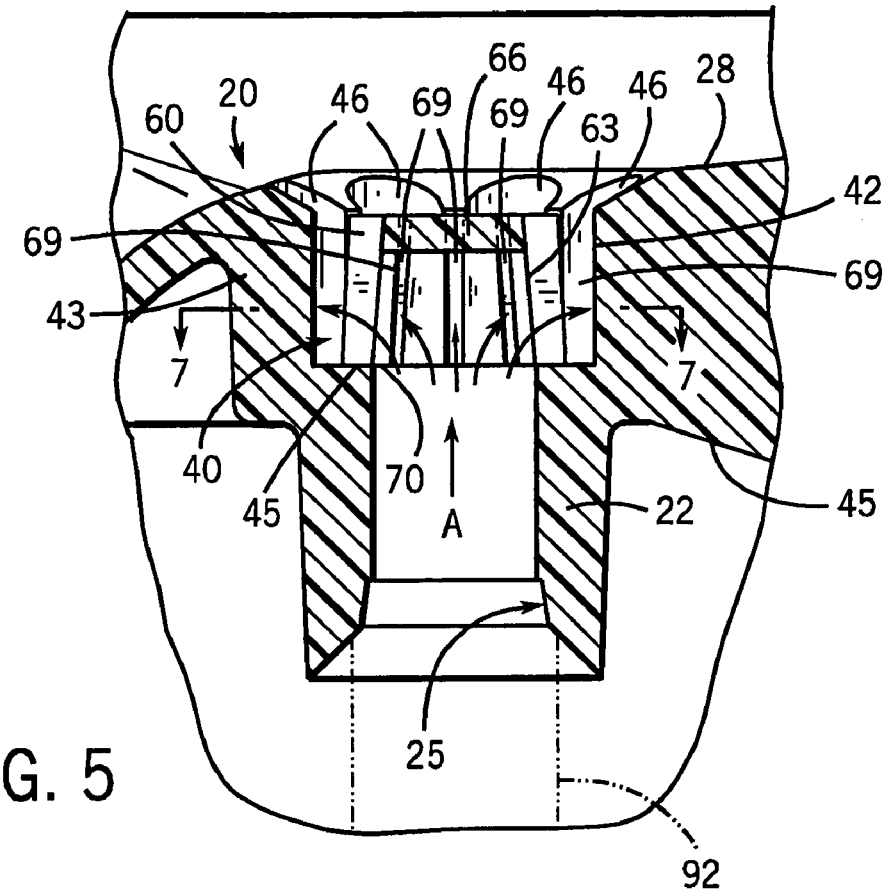
FIG. 5
FIG. 6
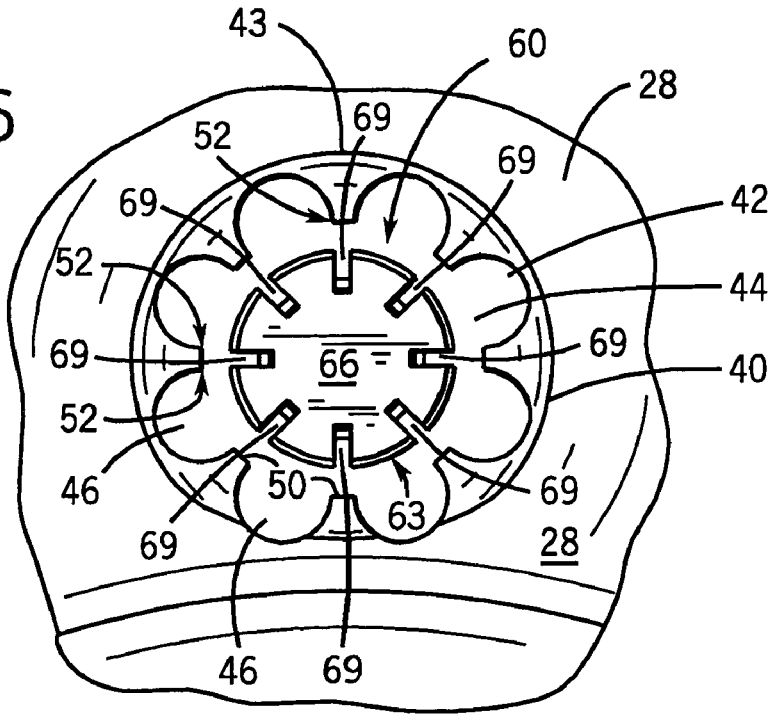

ACTUATOR FOR A PRESSURIZED MATERIAL DISPENSER

CROSS-REFERENCES TO RELATED APPLICATIONS

Not applicable.

STATEMENT REGARDING FEDERALLY SPONSORED RESEARCH

Not applicable.

BACKGROUND OF THE INVENTION

This invention relates to an actuator for a pressurized material dispenser such as an aerosol can. More particularly, it relates to an actuator that creates or enhances a foam from a foamable liquid or gel that was contained in the can.

Foam compositions are used in a number of skin and hair care products such as hand and body soap, shampoo, hair mousse, and especially shaving foam. In most such applications the foam is a mixture of (i) a foamable liquid or gel and (ii) a gas and/or propellant. Dispensers and dispensing nozzles for forming and dispensing a foam are well known. In the case of pump foam dispensers, a foamable liquid or gel and a gas (i.e., air) are used to create a foam, while in the case of many pre-pressurized material dispensers, a foamable liquid or gel and a propellant are used to create a foam.

A variety of mechanical devices for creating and/or enhancing such a foam are known. For example, U.S. Pat. No. 5,340,031 describes a head for a manually operated pressure container. The head has a discharge channel with an upper end which is partially closed by a deflecting plate. The channel is provided with passage slits which open out radially into a chamber. In operation, the product is deflected and foamed by the deflecting plate and directed against the a wall of the chamber and there foams again before axially exiting the head. This patent and all patents and published patent applications referred to herein are incorporated by reference as if fully set forth.

U.S. Pat. Nos. 4,429,814 and 4,860,933 and U.S. Patent Application Publication No. 2002/0130198 Al disclose other examples of heads for delivering a foam.

U.S. Pat. No. 6,264,964 discloses that aerosol propellants in pressurized metal cans may be employed in connection with foaming cosmetic products. Propellants listed include $C_1$–$C_6$ alkyl ethers, $C_3$–$C_6$ hydrocarbons (e.g., isobutane), halocarbons, carbon dioxide and mixtures thereof. Commercially available valves are described for regulating release of the foamable liquid or gel and propellant from the pressurized dispenser.

As such, while considerable prior art development has taken place in connection with systems to dispense foaming products, when a foaming mechanism is used to create a foam for a skin care product such as shaving foam, it is highly desirable that the foaming mechanism create a foam that has an acceptable feel to the consumer. For example, consumers prefer a shaving foam that is stable, thick and dense, that is permanent (i.e., stable over the time of use with no foam degradation), and that does not too easily run off when applied to skin.

It appears that acceptable shaving foams typically include a large number of stable small bubbles of generally uniform size. This has been found to correspond to a superior product feel and performance—a denser, more substantial and lasting foam. Foams without a large number of such stable uniform small bubbles have been associated with an overly thin feel that is not preferred by many consumers for a shaving foam.

$C_3$–$C_6$ hydrocarbon propellants such as isobutane have been used to create shaving foams having desirable feel characteristics. Typically, a portion of these propellants is dissolved in the product while it is still under pressure in the can. When the product is delivered from the can and is no longer under pressure, the dissolved propellant forms bubbles within the product, contributing to the foaming process and specifically aiding in the creation of small bubble, dense foams.

There has been interest in the use of a carbon dioxide propellant to create a foam from a pressurized material dispenser containing a foamable liquid or gel. However, because of the limited solubility of carbon dioxide in desirable foamable materials, a carbon dioxide propellant will not typically adequately produce a foam having the dense, substantial and lasting foam produced using a hydrocarbon propellant. For example, a foam produced using a carbon dioxide propellant may not have a large number of stable small bubbles of generally consistent size.

Therefore, there is a need for a way to better facilitate the production of a superior foam delivered from a pressurized container and, especially, to facilitate the production of such a foam when carbon dioxide is used as a propellant in such systems.

BRIEF SUMMARY OF THE INVENTION

In one aspect the invention provides an actuator for use with a pressurized material dispenser containing a material to be dispensed. A typical dispenser would be an aerosol can or pressure containing bottle. For economy of description, the dispenser will often be referred to herein as a "can." However, unless a contrary meaning is clear from the context, that term should be understood to include by implication pressure containing bottles and any other suitable pressure container. A typical material to be dispensed would be a foamable personal care product such as shaving cream or soap. In any event, the dispenser is of the type having a conventional aerosol-type valve, either having a valve stem projecting outward from the dispenser (a male valve) or having a structure adapted to receive an activating tube (a female valve). Male valves can be activated by pushing their valve stems downward towards the can, or, in alternative male "tilt" valve structures, by sideways motion of the valve stem. Female valves can be activated by sufficiently inserting an activating tube into the valve. Male valves are preferred, and the description, below, will be in terms of a male valve. However, an actuator having sufficient additional structure for use with female valves is within the scope of the invention.

The use of relative terms such as "top", "bottom", "upward" and "downward" and the like when describing the actuator of the invention is not intended to limit the orientation in which the actuator may be used. Such relative terms merely serve to more conveniently describe the invention. Unless the context clearly indicates the contrary, "downward" will refer to the direction toward the can or equivalent container with which the actuator is being used, with the "top" of the actuator referring to the part of the actuator furthest from the can.

The actuator of the present invention has a skirt suitable for being attached to the dispenser, and a trigger linked to the skirt in a manner permitting relative movement between the trigger and skirt. In particular accordance with the present invention, the trigger has a flow conduit, a flow diverter, and a discharge chamber. The flow conduit terminates at one end in a stem socket that is dimensioned and positioned for mating with the valve stem. Alternatively, if a female valve is used, the flow conduit terminates in an activating tube insertable in the female valve in the conventional manner, as is referred to, above. Such stem sockets and activating tubes, together with any other conventional means for activating a valve, constitute means for mating with the valve in material-transmitting relation and for activating the valve when depressed toward the valve. The stem socket is suitable to exert pressure against the valve stem when the trigger is moved toward the dispenser to thereby dispense contents of the dispenser.

The flow conduit terminates at an opposite end from said one end at a hollow flow diverter. This diverter has an axial opening facing said conduit at one end of the flow diverter, a wall at an end of diverter opposite said one end of the flow diverter, and a plurality of radially opening, axially extended slots in communication with the interior of the diverter and thus with the diverter axial opening.

The discharge chamber is positioned in the trigger radially outward from the radially opening slots, which open into the discharge chamber. The chamber has an outer side wall with a plurality of recesses separated by deflection regions. Preferably, at least one of the deflection regions has a portion that is circumferentially aligned with respect to one of the radially opening slots of the flow diverter.

In the most preferred forms, the recesses are spaced apart, longitudinal recesses in the side wall of the discharge chamber, the recesses have a curved inner surface, and at least one of the deflection regions is in the form of a land between adjacent recesses where the land has a surface selected from the group consisting of flat surfaces, peaked surfaces, and curved surfaces. In such embodiments, at least one such slot can be positioned such that at least part of the contents of the dispenser can be directed against at least one land of the side wall of the chamber before that part of the contents flows into a recess in the side wall of the chamber when the valve has been activated by the trigger. Preferably, each slot is positioned such that contents flowing through the slot is directed against a deflection region.

In other preferred forms, the flow diverter is tubular, the recesses have a greater longitudinal length than the slots, and the skirt, the trigger, the flow conduit, the chamber and the flow diverter are all integrally molded from a thermoplastic material.

In another aspect the invention provides an aerosol can dispenser where there is a can containing a pressurized material to be dispensed. The can has a valve stem projecting outward from the can, and there is an actuator positioned on the can. In this form of the invention the actuator has a skirt suitable for being mounted on the can, and a trigger linked to the skirt in a manner permitting relative movement between the trigger and skirt. Here the trigger has (i) a flow conduit terminating at one end in a stem socket dimensioned and positioned for receiving the valve stem, the stem socket being suitable to exert pressure against the valve stem when the trigger is moved toward the can to thereby dispense contents of the can, and terminating at an opposite end from said one end in a hollow flow diverter; wherein said flow diverter has an axial opening facing said conduit at one end of the flow diverter, a wall at an end of the flow diverter opposite the one end of the flow diverter, and a plurality of radially opening, axially extended slots in communication with the diverter axial opening; and (ii) a discharge chamber radially outward of said radially opening slots, the chamber having a side wall with a plurality of recesses separated by deflectors.

In yet another aspect of the invention there is provided a method of producing a foamed skin care product using the above actuator installed on an aerosol can or equivalent pressure containing vessel. One presses the trigger of the actuator to deliver a foamed skin care product.

Alternatively described, the invention is an actuator orifice for use with a pressurized, foamable product. The actuator orifice includes a hollow flow diverter having at one end an axial opening to receive foamable product delivered thereto under pressure, a wall at an end of the diverter opposite the one end of the flow diverter, and a plurality of radially opening slots in communication with the diverter's axial opening. The actuator orifice further includes a discharge chamber radially outward of said radially opening slots, the chamber having a side wall with a plurality of recesses separated by deflection regions, at least one of the deflection regions having a portion that is circumferentially aligned with respect to one of the radially opening slots of the flow diverter, and an opening from which foamed product can be discharged into the hand of a user.

Preferably the recesses of the actuator orifice are spaced apart, longitudinal recesses in the side wall of the discharge chamber, and preferably a plurality of the recesses have a curved inner surface. In another aspect of the actuator orifice invention, at least one of the deflection regions is in the form of a land between adjacent recesses. Preferably, the land has a surface selected from the group consisting of flat surfaces, peaked surfaces, and curved surfaces. In a preferred embodiment of the actuator orifice, at least one of the slots is so positioned that at least a part of the pressurized foamable product passing through the orifice is directed against at least one land of the side wall of the chamber. Preferably the flow diverter is tubular, and preferably the recesses have a greater longitudinal length than the slots. It is preferred that the slots be of substantially uniform width over their length.

The above structures insure that, as much of the product to be dispensed passes into the actuator (or, alternatively described, through the actuator orifice), it is forced against a variety of surfaces with various shear characteristics. This, together with the forceful agitation of the product, creates a mechanical action that is particularly beneficial in creating and/or enhancing a foam generated from a foamable liquid or gel.

These and still other features and advantages of the present invention will be apparent from the description which follows. It should be noted that the following description is of the preferred embodiments only. The claims are not so limited. Thus, the claims should be looked to in order to judge the full scope of the invention.

BRIEF DESCRIPTION OF THE DRAWINGS

FIG. 1 is a perspective view of an actuator in accordance with the present invention;

FIG. 2 is a top plan view thereof;

FIG. 3 is a bottom plan view thereof;

FIG. 4 is a cross-sectional view taken along line 4—4 of FIG. 2;

FIG. 5 is a detailed sectional view taken along line 5—5 of FIG. 4;

FIG. 6 is a detailed view taken along line 6—6 of FIG. 2;

DETAILED DESCRIPTION OF THE PREFERRED EMBODIMENTS OF THE INVENTION

Figure 7:
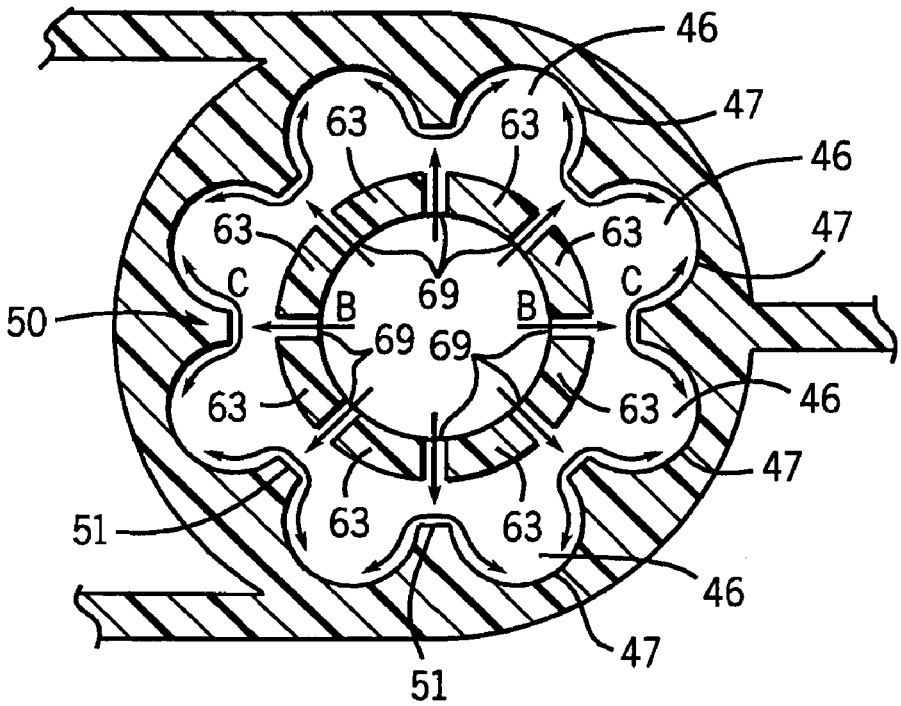
FIG. 7 is a cross-sectional view taken along line 7—7 of FIG. 5.

Referring to FIGS. 1–7, there is shown an actuator according to the invention, indicated generally at 10, for use with a pressurized material dispenser. The dispenser, shown in FIG. 4 at 90 in phantom lines, can be of any conventional type currently used for holding and dispensing pressurized foamable material (e.g. a canister used to dispense Edge® shaving gel or cream, marketed by S. C. Johnson & Son, Inc.).

The pressurized material dispenser 90 includes the usual valve 91 having the usual valve stem 92. The pressurized material dispenser 90 also includes a rim 94. Although the pressurized dispenser 90 is depicted as a generally conventional aerosol can, the actuator 10 can be configured to be used with pressure-containing bottles and other vessels of various shapes, either equipped with a structure comparable to the rim 94 or with other features that can serve as attachment points for the actuator, as will be described below. The actuator 10 according to the invention may be used to create a foam from a foamable liquid or gel delivered from the pressurized material dispenser 90 and/or may be used to enhance or improve a foam delivered from the pressurized material dispenser 90.

The actuator 10 includes a skirt 14 having ribs 16 extending inward from an inner surface of a lower portion of the skirt 14. The ribs 16 engage the rim 94 of the pressurized material dispenser 90 to attach the actuator 10 to the pressurized material dispenser 90. Alternatively, the actuator 10 can be attached to other structures of a pressurized material dispenser by any of the many conventional means for the attachment of actuator caps to conventional aerosol cans or to pressure bottles or the like. Common points of attachment are to structures such as the rim 94 shown, to seams at which valve mechanisms attach to cans or pressure bottles, to collars or other structures formed in bottles, and the like. All of such means for attachment are within the scope of the invention, it being necessary only that the skirt 14 be secured directly or indirectly to the pressure container.

The actuator 10 also includes a trigger 20 mounted to the skirt 14 by a resilient attachment web 34 which allows the trigger 20 to be moved down toward the dispenser 90 in a pivoting fashion by application of finger pressure on push pad 32.

It should be understood that the actuator 10 is merely one embodiment wherein the trigger 20 is shown at the top of the actuator 10. Thus, as has already been stated, above, the use of relative terms such as "top", "bottom", "upward" and "downward" and the like when describing the actuator 10 is not intended to limit the orientation in which the actuator 10 may be used. Such relative terms merely serve to more readily describe the embodiment of the actuator 10 shown in FIGS. 1 to 7.

The trigger 20 includes a flow conduit 22, a discharge chamber 40 that extends downwardly, away from the surface 28 of the trigger 20, and a hollow flow diverter 60 located within the discharge chamber 40. The foamed contents (e.g., a foam formed from any suitable foamable liquid or gel, and a propellant) of the pressurized material dispenser 90 exit the actuator 10 at the chamber 40. Preferably, the skirt 14, the trigger 20, the flow conduit 22, the chamber 40 and the flow diverter 60 are integrally molded from a thermoplastic material such as polypropylene or polyethylene using conventional molding techniques.

The actuator 10 may be used to dispense the foamed contents of the pressurized material dispenser 90 when oriented in any manner. For example, the actuator 10 and dispenser 90 may be oriented such that the actuator 10 is below the pressurized material dispenser 90 whereby the contents of the pressurized material dispenser 90 are released downward from the dispenser 90. Likewise, the actuator 10 and dispenser 90 may be oriented such that the actuator 10 is above the pressurized material dispenser 90 whereby the contents of the pressurized material dispenser 90 are released upward from the dispenser 90. Similarly, the actuator 10 and dispenser 90 may be oriented such that the actuator 10 is sideways from the pressurized material dispenser 90 whereby the contents of the pressurized material dispenser 90 are released laterally from the dispenser 90.

Referring now to FIGS. 4–7, the chamber 40 of the trigger 20 extends downward from the top surface 28 of the trigger 20. A side wall 42 of the chamber 40 defines a discharge passageway 44 that extends from the floor 45 of the chamber 40 to an opening 43 in the top surface 28 of the trigger 20. Preferably, the discharge passageway 44 includes a tubular section that extends from the floor 45 of the chamber 40 to the opening 43 in the top surface 28 of the trigger 20 without any obstruction that may affect the foaming process.

The side wall 42 of the chamber 40 has a plurality of recesses 46. In the embodiment shown in FIGS. 1–7, the recesses 46 are spaced apart and longitudinally arranged (in relation to an axis of the chamber 40) such that the recesses 46 extend from the floor 45 of the chamber 40 to the top surface 28 of the trigger 20. In the embodiment shown in FIGS. 1–7, the recesses 46 have a curved inner surface 47, and lands 50 with a flat surface 51 are located between each of the recesses 46.

The flow diverter 60 is in the form of a hollow pedestal centrally located within the chamber 40. The flow diverter 60 has a circular side wall 63 extending upward from the floor 45 of the chamber 40, and an end wall 66 connected to and extending inwardly from the side wall 63. The side wall 63 of the flow diverter 60 has a plurality of radially opening slots 69 that extend longitudinally with respect to the flow diverter. Optionally, the slots 69 may extend through the end wall 66 of the tubular flow diverter 60 as shown in FIG. 6, an arrangement that facilitates molding. In the embodiment shown in the drawings, the end wall 66 is located below the top surface 28 of the trigger 20.

Preferably, the slots 69 are of uniform width over their length. This insures that the back pressure on material flowing out through the slots 69 is substantially constant over the length of the slots, causing a uniform release of material through the slots. This, in turn, causes a more uniform turbulence throughout the released material and therefore a more uniform bubble formation in the foam issuing from the actuator 10. It is normal practice in designing molded parts to design in "draft"—a widening of depressions or other features in the direction that a tool must be extracted to allow easy withdrawal of mold cores and similar mold features used to create such molded features. Thus the use of slots 69 of substantially uniform width over their length overrules that conventional design practice and leads to improved actuator function. Conventionally designed, widening slots would favor release of material through their widest portions to create bubbles larger than desired or, in any event, to create a mixture of larger and smaller bubbles to produce a foam of less desirable characteristics.

The flow conduit 22 of the trigger 20 extends downwardly from the floor 45 of the chamber 40, and terminates in a stem socket 25 that is dimensioned in a conventional fashion to receive the valve stem 92 of the dispenser 90 when the dispenser is equipped with a male valve. The stem socket 25 exerts pressure on the valve stem 92 when the trigger 20 is moved downward toward the dispenser 90 by application of finger pressure on push pad 32 of the trigger 20. Movement of the valve stem 92 opens the valve 91 and releases the contents of the dispenser 90 into the flow conduit 22. The contents then flow into the discharge passageway 44 by way of the slots 69 in the side wall 63 of the flow diverter 60 which provide fluid paths between the flow conduit 22 and the discharge passageway 44.

As discussed, above, the dispenser 90 can alternatively be equipped with a conventional female valve (not shown), in which case, instead of a stem socket 25, the flow conduit 22 would extend as an activating tube (not shown) sized to be inserted into the female valve in conventional, sealing relation and having a length sufficient to open the valve when the trigger 20 is moved downwardly toward the dispenser 90 by application of finger pressure on the push pad 32 of the trigger.

Preferably, the recesses 46 in the side wall 42 of the chamber 40 are equally spaced apart, parallel longitudinal recesses, and the slots 69 in the side wall 63 of the flow diverter 60 are equally spaced apart, parallel longitudinally extending slots. The actuator is particularly beneficial when the number of recesses 46 is in the range of 4 to 8, and the number of slots 69 is in the range of 4 to 8. Preferably, the recesses 46 have equal widths, the slots 69 have equal widths, and the recesses 46 have a greater longitudinal length than the slots 69. Preferably, each slot 69 is aligned with a land 50 located between two adjacent recesses 46. When the slots 69 are so aligned with the lands 50, the lands serve as deflection regions that receive the impact of the flow of material passing through the slots and deflect that flow generally circumferentially.

In operation, the valve stem 92 seals to actuator 10 at stem socket 25 when the push pad 32 of the trigger 20 is depressed downward. Upon depressing the push pad 32, product is released from the pressurized material dispenser 90 and passes the seal point and begins to travel from valve stem 92 through the flow conduit 22 towards the flow diverter 60 as shown by arrow A in FIG. 5. Upon striking against the end wall 66 of the flow diverter, the product is redirected 90 degrees from its original path and is forced through radially opening slots 69 in the side wall 63 of the flow diverter 60. The slots 69 provide shear edges by which to break down the product into finer, smaller sized, bubbles and direct the product into lands 50 that will continue to provide additional mechanical action to the product further downstream.

After being forced through the slots 69, the product continues out, radially, at an increased velocity, striking lands 50 directly opposite the slots 69. These lands 50 have, at the point at which the product comes into contact with the lands 50, a blunt surface with sharp corners 52 that provide another shear edge for the product to pass across, providing additional agitation (see arrows B and C in FIG. 7). After passing across the lands 50, the product is directed into the recesses 46 in the side wall 42 of the chamber 40 (see arrow C in FIG. 7). The product when striking against the lands 50 has its flow direction funneled into the recesses 46 in the side wall 42 of the chamber 40. The product flows from each and every slot 69 and is directed into the adjacent recesses 46 on either side of the slot 69 causing the product to agitate against itself adding more mechanical action to the product before it makes its way to the consumer. The curvature of the recesses 46, which may be greater than, equal to or less than a full radius, or may be any part of an arc or angle, will lead separate streams of the product to flow into each other at the back of the recesses 46 just prior to exiting the chamber 40 and being received by the consumer.

It can be seen from FIGS. 1 to 7 that the product (as it exits axially from the valve 91 of the dispenser 90) must first change direction to exit radially out of the slots 69. It then hits the lands 50 and moves somewhat circumferentially over the corners 52 of the lands 50 and then again axially after contacting the recesses 46 in the side wall 42 of the chamber 40 to exit the actuator 10. The product swirls up in the recesses 46 in the side wall 42 of the chamber 40.

Also, the cross-sectional size of the chamber is greater than that of the valve 91 slowing the movement of the swirling product from the chamber 40. The result of all of this is turbulence, shearing, and mixing such as to create an improved foam, as evidenced by bubble size and uniformity measurements. Specifically, a large number of small bubbles of generally consistent size is produced. This corresponds to a superior product feel and performance—a denser, more substantial and lasting foam.

Figure 7A:
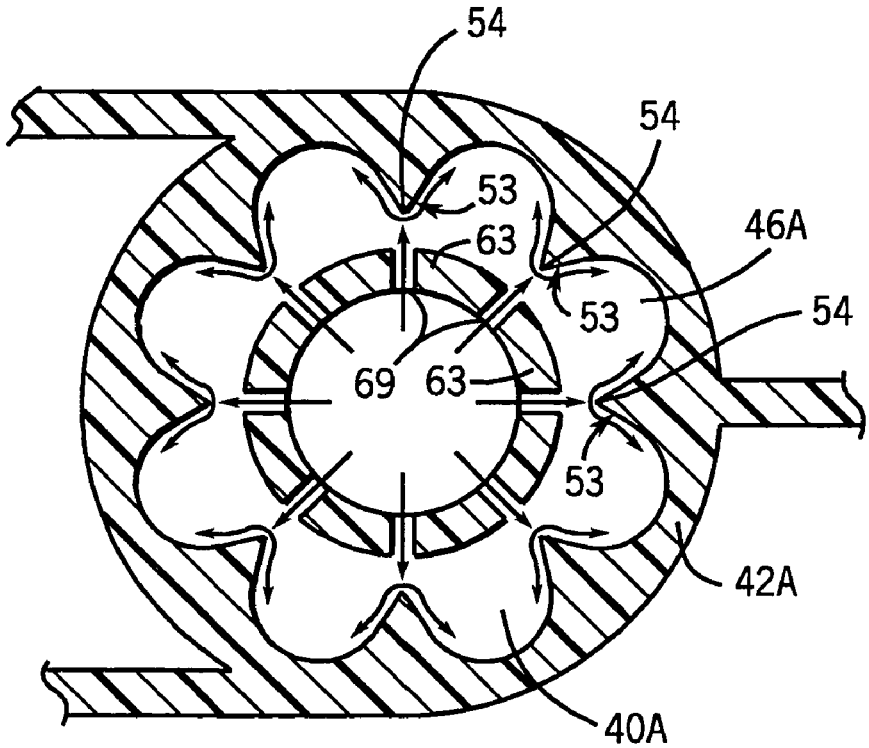
FIG. 7A is a view similar to FIG. 7, albeit of a second embodiment of the present invention.
Figure 7B:
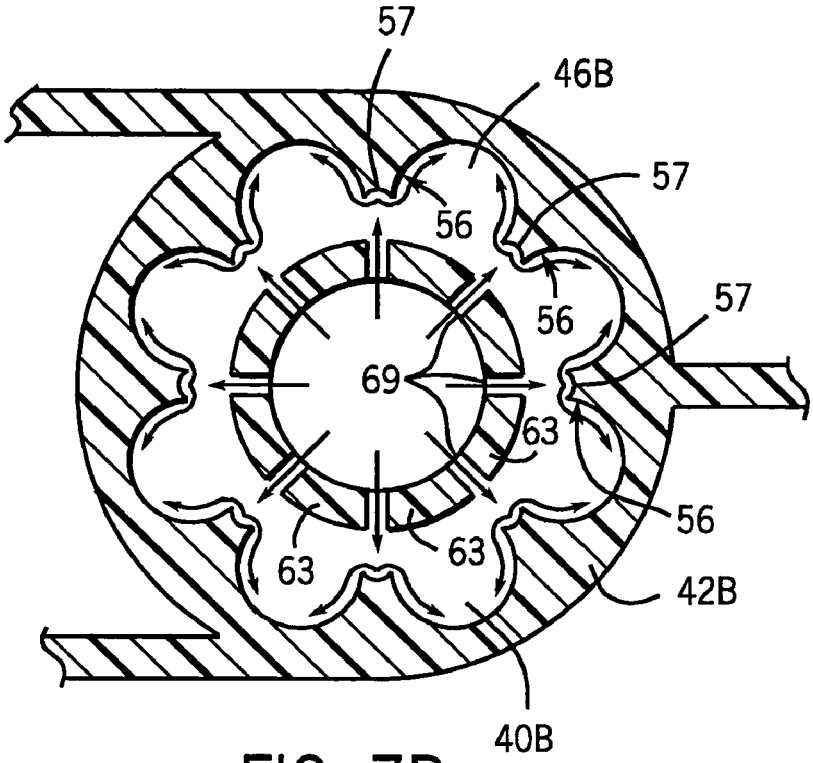
FIG. 7B is a view similar to FIG. 7A, albeit of a third embodiment.
Figure 7C:
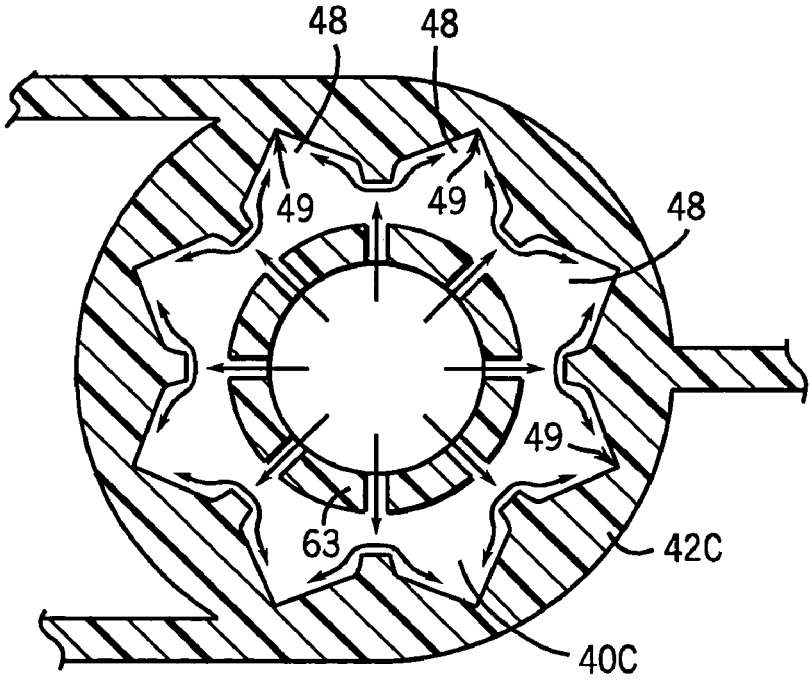
FIG. 7C is a view similar to FIG. 7B, albeit of a fourth embodiment.

Turning now to FIGS. 7A–C, analogous parts are referred to by similar numbers, albeit with a letter identification to specify the particular alternative embodiment. With reference to FIG. 7A, there is shown the configuration of the side wall of the chamber of another embodiment of the actuator. In this embodiment, the land 53 between the recesses 46A in the side wall 42A of the chamber 40A has a peaked edge 54 to provide an alternative shearing action on the product exiting the slots 69 in the side wall 63 of the flow diverter 60. The flow path of the product is indicated by the arrows in FIG. 7A.

Turning now to FIG. 7B, there is shown the configuration of the side wall of the chamber of yet another embodiment of the actuator. In this embodiment, the land 56 between the recesses 46B in the side wall 42B of the chamber 40B has a curved surface 57 to provide an alternative shearing action on the product exiting the slots 69 in the side wall 63 of the flow diverter 60. In the embodiment shown, the curved surface 57 is concave. However, the curved surface may also be convex. The flow path of the product is indicated by the arrows in FIG. 7B.

Turning now to FIG. 7C, there is shown the configuration of the side wall of the chamber of still another embodiment of the actuator. In this embodiment, the inner surfaces of the recesses 48 in the side wall 42C of the chamber 40C have a section forming an angle, indicated at 49, of less than 180 degrees to provide an alternative agitating action on the product exiting the slots 69 in the side wall 63 of the flow diverter 60. The flow path of the product is indicated by the arrows in FIG. 7C.

Alternatively described, the actuator orifice of the invention includes the hollow flow diverter 60, with the features described, above, and having at one end an axial opening 70 (best seen in FIG. 5) to receive foamable product delivered thereto under pressure, and the discharge chamber 40, with the features described, above.

Thus, there has been provided an actuator and an actuator orifice that creates or enhances foam from a foamable liquid or gel delivered from a pressurized material dispenser such as an aerosol can or other pressure bottle or vessel. The actuator is particularly well suited to enhance a foam generated using a foamable liquid or gel and a carbon dioxide propellant.

Although the present invention has been described in detail with reference to certain embodiments, one skilled in the art will appreciate that the present invention can be practiced by other than the described embodiments, which have been presented for purposes of illustration and not of limitation. For example, the trigger panel need not move in a pivoting manner, instead a vertical movement could suffice. Therefore, the scope of the appended claims should not be limited to the description of the embodiments contained herein.

INDUSTRIAL APPLICABILITY

Actuators are provided for use with aerosol cans and the like, where the actuators facilitate stable foam formation during dispensing.

What is claimed is:

1. An actuator for use with a pressurized material dispenser containing a material to be dispensed and having a valve, the actuator comprising:

a skirt suitable for being secured to the dispenser; and a trigger linked to the skirt via a web in a manner permitting relative movement between the trigger and skirt, the trigger comprising:

a flow conduit terminating at one end in a means for mating with the valve in material-transmitting relation and for activating the valve when the trigger is moved toward the dispenser to thereby dispense contents of the dispenser via the flow conduit, the flow conduit terminating at an opposite end from said one end at a hollow flow diverter;

wherein said flow diverter has a side wall and an axial opening facing said conduit at one end of the flow diverter, a wall at an end of diverter opposite said one end of the flow diverter, and at least 4 radially opening slots in the side wall and in communication with the diverter axial opening;

the trigger also comprising a discharge chamber radially outward from said radially opening slots, the chamber being in communication with said slots and having an outer side wall with a plurality of recesses separated by deflection regions, at least one of the deflection regions having a portion that is circumferentially aligned with respect to one of the radially opening slots of the flow diverter; and wherein the actuator is configured such that when linked to said pressurized material dispenser it is suitable to deliver the material to be dispensed in an axial direction.

2. The actuator of claim 1 wherein the recesses are spaced apart longitudinal recesses in the side wall of the discharge chamber.

3. The actuator of claim 2 wherein more than one of the plurality of recesses has a curved inner surface.

4. The actuator of claim 2 wherein at least one of such deflection regions is in the form of a land between adjacent recesses.

5. The actuator of claim 4 wherein the land has a surface selected from the group consisting of flat surfaces, peaked surfaces, and curved surfaces.

6. The actuator of claim 5 wherein at least one such slot is positioned such that at least part of the contents of the dispenser can be directed against at least one land of the side wall of the chamber before that part of the contents flows into a recess in the side wall of the chamber when the valve has been activated by the trigger.

7. The actuator of claim 1 wherein the flow diverter is tubular.

8. The actuator of claim 1 wherein the recesses have a greater longitudinal length than the slots.

9. The actuator of claim 1 wherein the slots are of substantially uniform width over their length.

10. A pressure container dispenser comprising:

a pressure container containing a pressurized material to be dispensed, the pressure container having a valve stem projecting outward from the pressure container; and an actuator positioned on the pressure container, the actuator comprising:

a skirt suitable for being secured to the pressure container; and a trigger linked to the skirt via a web in a manner permitting relative movement between the trigger and skirt, the trigger comprising:

(i) a flow conduit terminating at one end in a stem socket dimensioned and positioned for receiving the valve stem, the stem socket being suitable to exert pressure against the valve stem when the trigger is moved toward the pressure container to thereby dispense contents of the pressure container, and terminating at an opposite end from said one end in a hollow flow diverter; wherein said flow diverter has a side wall and an axial opening facing said conduit at one end of the flow diverter, a wall at an end of diverter opposite the one end of the flow diverter, and at least 4 radially opening slots in the side wall and in communication with the diverter axial opening; and (ii) a discharge chamber radially outward of said radially opening slots, the chamber having a side wall with a plurality of recesses separated by deflection regions; and wherein the actuator is suitable to deliver the material to be dispensed in an axial direction.

11. A method of producing a foamed skin care product, comprising:

obtaining a pressure container of claim 10; and pressing the claim 10 trigger to dispense foamed skin care product.

12. An actuator orifice for use with a pressurized, foamable product comprising:

a hollow flow diverter having a side wall and having at one end an axial opening to receive foamable product delivered thereto under pressure, a wall at an end of the diverter opposite the one end of the flow diverter, and at least 4 radially opening slots in the side wall and in communication with the diverter axial opening; and a discharge chamber radially outward of said radially opening slots, the chamber having a side wall with a plurality of recesses separated by deflection regions, at least one of the deflection regions having a portion that is circumferentially aligned with respect to one of the radially opening slots of the flow diverter, the discharge chamber also including an opening from which foamed product can be discharged into the hand of a user;

wherein more than one of the plurality of recesses has a curved inner surface.

13. The actuator orifice of claim 12 wherein the recesses are spaced apart, longitudinal recesses in the side wall of the discharge chamber.

14. The actuator orifice of claim 13 wherein at least one of the deflection regions is in the form of a land between adjacent recesses.

15. The actuator orifice of claim 14 wherein the land has a surface selected from the group consisting of flat surfaces, peaked surfaces, and curved surfaces.

16. The actuator orifice of claim 14 wherein at least one such slot is so positioned that at least part of the pressurized foamable product passing through the orifice is directed against at least one land of the side wall of the chamber.

17. The actuator orifice of claim 12 wherein the flow diverter is tubular.

18. The actuator orifice of claim 12 wherein the recesses have a greater longitudinal length than the slots.

19. The actuator orifice of claim 12 wherein the slots are of substantially uniform width over their length.

* * * * *